United States Patent [19]

Mack

[11] Patent Number: 4,549,827

[45] Date of Patent: Oct. 29, 1985

[54] WRITING IMPLEMENT WITH TWO RETRACTABLE CARTRIDGES

[76] Inventor: Wolfgang Mack, Tannenweg 4, D-6492 Sinntal-Sannerz, Fed. Rep. of Germany

[21] Appl. No.: 571,474

[22] Filed: Jan. 17, 1984

[30] Foreign Application Priority Data

Jan. 20, 1983 [DE] Fed. Rep. of Germany ... 8301410[U]

[51] Int. Cl.[4] ..... B43K 27/12; B43K 24/02

[52] U.S. Cl. ..... 401/29; 401/31; 401/34; 401/104; 401/109

[58] Field of Search ..... 401/29, 195, 31, 109, 401/34, 99, 104

[56] References Cited

U.S. PATENT DOCUMENTS 889,435 6/1908 Bustanoby ..... 401/34

3,311,089 3/1967 Vogel ..... 401/99

3,352,621 11/1967 Fehling et al. ..... 401/109

3,407,021 10/1968 Mosch ..... 401/29

4,081,217 3/1978 Klaber ..... 401/195 X

*Primary Examiner*—Steven A. Bratlie

*Attorney, Agent, or Firm*—Max Fogiel

[57] ABSTRACT

In a writing implement with two cartridges (12,22) the housing is divided in two parts connected together by a pivot. The cartridges are pressed by spring force against cams (**14*a*,24*a*) which are arranged on the other housing. The cams have such a profile that the writing points (12*a*,22*a***) are driven out in the opened position of the housings but retracted in the closed position into the housings. The closing action retracts the writing points into the housings; the opening out action drives out the writing points.

12 Claims, 6 Drawing Figures

WRITING IMPLEMENT WITH TWO RETRACTABLE CARTRIDGES

BACKGROUND TO THE INVENTION

This invention relates to a writing implement with two cartridges for each of which is provided a spring and a housing enclosing the cartridge and spring, and also a connecting part connecting the housings.

Writing implements with two cartridges (ball points) are known in which the two housings and the connecting part joining them are formed as a continuous elongate housing. The ends of this rigid housing are fitted with cartridges of different colors. Such a writing implement is, however, inconvenient, as it is more than twice as long as the length of a single cartridge, which is to say that its length is even more than twice what is necessary for writing with. If the individual cartridges are arranged side-by-side, the writing instrument becomes relatively large in girth, and not well suited to writing with.

With the known, elongate writing implements, the writing points are permanently outside the housings and they additionally have a substantial liability of soiling things, so that the known writing implements cannot directly be put into an article of clothing.

The invention is based, on the problem of providing a writing implement of the kind referred to which occupies the smallest volume, which does not give rise to the risk of soiling clothes and with which nevertheless good writing is possible. It is especially useful if such a writing implement is also easily secured in the pocket.

SUMMARY OF THE INVENTION

The solution to the problem is found according to the invention in the writing implement described, in which:

(a) the connecting part is formed as a joint for relative pivoting of the two housings (b) each housing has as its pivot end, remote from the writing point, a cam for sliding lengthwise the cartridge of the other housing, and (c) the cam has such a profile that the writing point is driven out when the housings are opened, but retracted in the closed position of the housings.

The principle of the present invention is based on the condition that the writing points are driven out by the cams in the opened position of the housings so that both ends of the writing implement are available for writing. When folding the two halves together, the springs push back the writing points into the housings against the cams, so that in the folded position of the housings, no ink can get from the cartridges to the clothes when the writing implement is carried in the pocket. Through the presence of the springs in the housings, a tangential component of force is produced on the cams which has the tendency, at least in the latter part of the pivotal movement in folding up the implement, to press the two housings together. On this basis, the writing implement has a clamping effect, so that, for example, one housing can be on the inside of a pocket open to the top, while the other housing is outside the pocket.

It is particular advantageous if the cams have such a shape that in the folded up position of the housing, a section of the cam with a greater inclination with respect to the pivot axis acts on the spring loaded cartridge. As the tangential force is proportional to the inclination, this gives rise to an especially large closing force or clamping effect in the closed position of the housings.

According to further features of the invention, it is additionally advantageous if the spring loaded cartridges have a small retractile movement as the opened out position of the housings is approached. The cams have here a substantially dead point so that the opened position of the housings is a so-called stable position. In other words: for the purpose of closing up the two housings, the cartridges first have to be pushed out a little way against the spring force. This gives rise to a noticeable resistance, which reliably holds open the writing implement. It will be understood that the small retractile movement on opening the writing implement is only to that extent that the writing points stay outside the housings.

It is, furthermore, particularly advantageous if between the end of the cartridge and the cam that acts on it, there is arranged a plunger which is guided in the lengthwise bore and which abuts against the spring. Such a plunger can have a hollow projection as guide element, into which the end of the cartridge can be inserted and held. In this way, the axial forces from the cams are transmitted reliably to the cartridges and converted to a lengthwise motion. By a suitable choice of combination for the cam and plunger, a reliable locking action can be achieved while avoiding jamming. Furthermore, such an arrangement facilitates exchange of cartridges without the risk of losing parts of the writing implement.

It is additionally conceivable that the writing implement could be provided with a flexible sleeve which simply has an opening in the region of the cams so that the whole forms a unit in which the individual parts including the ends of the cartridges and the like are concealed.

BRIEF DESCRIPTION OF THE DRAWINGS

The invention will now be further described with reference to the following drawings, which show.

DESCRIPTION OF THE PREFERRED EMBODIMENT

Figure 1:
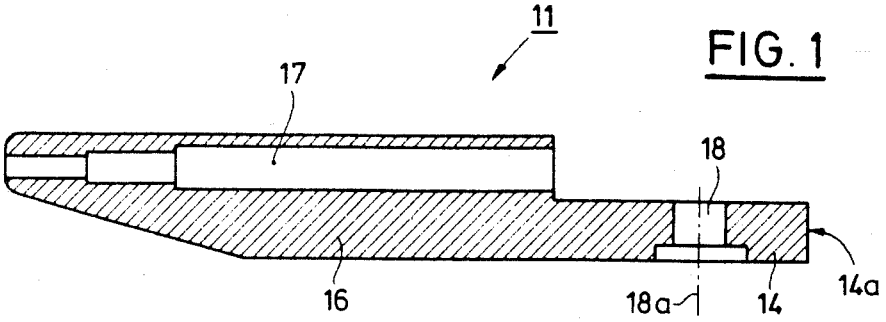
FIG. 1 is a lengthwise section along the line I—I in FIG. 2 through a housing.
Figure 2:
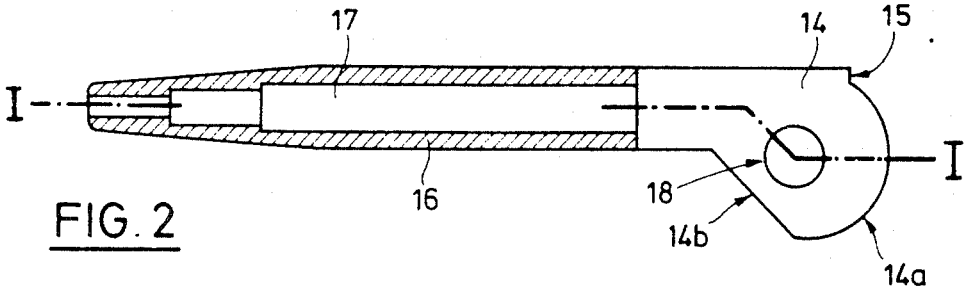
FIG. 2 is a partial lengthwise section through the housing of FIG. 1 with a plan view of the flattened hinge part.
Figure 4:
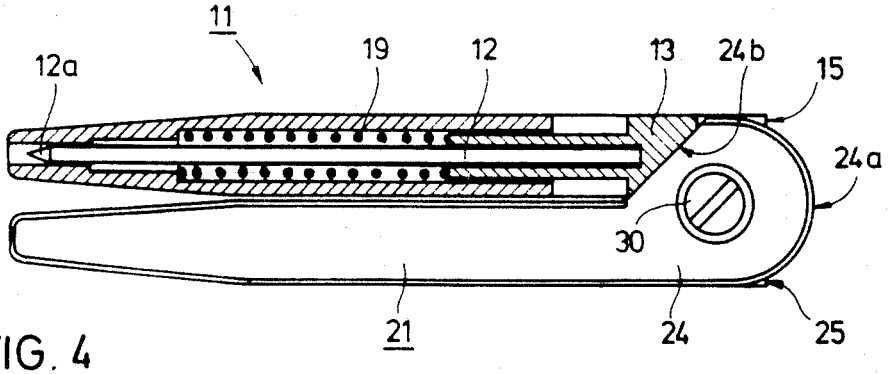
FIG. 4 is a partial lengthwise section through the closed complete writing implement.
Figure 6:
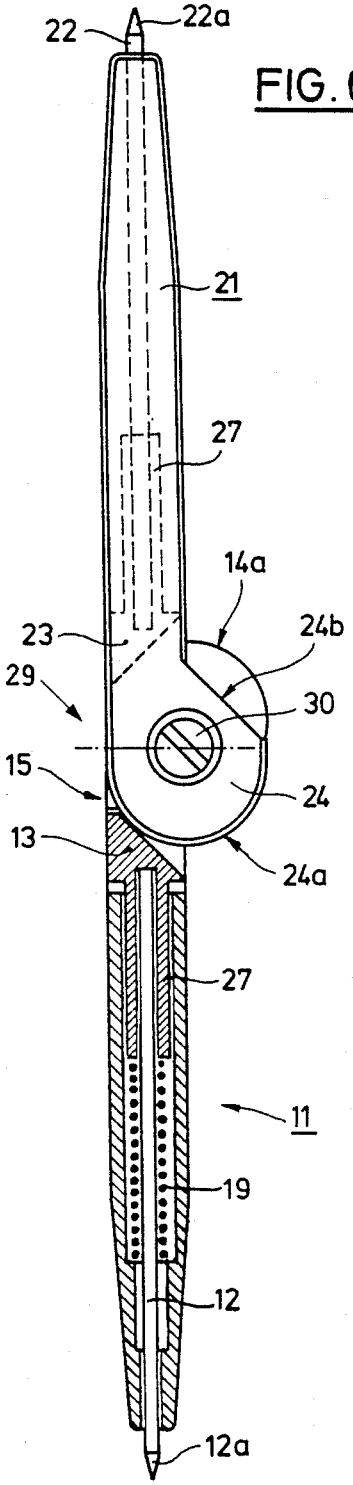

In FIG. 1 a housing 11 is shown which is identical with the housing 21 (FIGS. 4 and 6). Each of the housings comprises a tubular barrel 16 in which is formed a lengthwise bore 17, and also a flattened hinge part 14,24 at the side of the lengthwise bore. In the hinge part there is arranged a transverse bore 18 for a pivot axis 30. The end of each hinge part 14,24 enclosing the transverse bore 18 has a cam **14*a*,24*a***.

As shown in FIGS. 4 and 6, a cartridge 12,22 is inserted into each bore 17. The cartridges have a writing point **12*a*,22*a*. In the bore 17 is additionally a spring 19** surrounding the cartridge 12,22, which is formed as a compression spring. This spring abuts against a shoulder (not referenced) in the bore 17 at one end, and, at its other end, on a plunger 13,23, described further with reference to FIG. 3.

Figure 3:
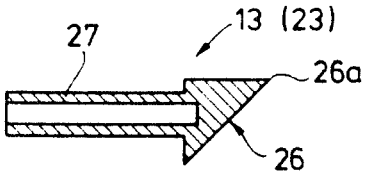
FIG. 3 is a lengthwise section through a plunger.

From FIG. 3 it is seen that the plunger 13,23 has a cam face 26 and a projection 27 formed as a hollow cylinder and which serves, by its outer face, as a guide element in the wider part of the bore 17. The end of the cartridge 12,22 is inserted into the projection 27 as shown in FIGS. 3 and 6.

The cam face 26 is part of a prismatic body of plastic and extends at an angle of about 45° to the lengthwise axis of the projection 27 which is formed on the body. The cam face 26 rests, in the closed position of the housings, on a part **14*b*,24*b* of the cam 14*a*,24*a* of the other housing, as shown in FIG. 4. The parts 14*b*,24*b* are planes angled complementarily to the cam face 26. These have a maximum inclination to the pivot axis 30 so that the writing implement can be opened out from its position as shown in FIG. 4** only with an initially greater effort.

The cam face 26 has an edge **26*a* with the widest part to the outside. In its assembled position it runs parallel to the axis 18*a* of the transverse bore 18 or the pivot axis 30 (FIGS. 1 and 4). The edge 26*a* abuts, on reaching the opened position shown in FIG. 6, on an abutment 15,25 of the other housing. The abutments 15,25 form steps at the ends of the cams 14*a*,24*a*, by which the housings are locked in the position shown in FIG. 6. The remaining run of the cams 14*a*,24*a* corresponds with the exception of the parts 14*b*,24*b* to a circular arc which is eccentric to the axis 18*a* of the transverse bore 18**. By virtue of the position of the eccentric axis, the cartridges, on reaching the opened position of the housings, execute a small retractile movement.

Figure 5:
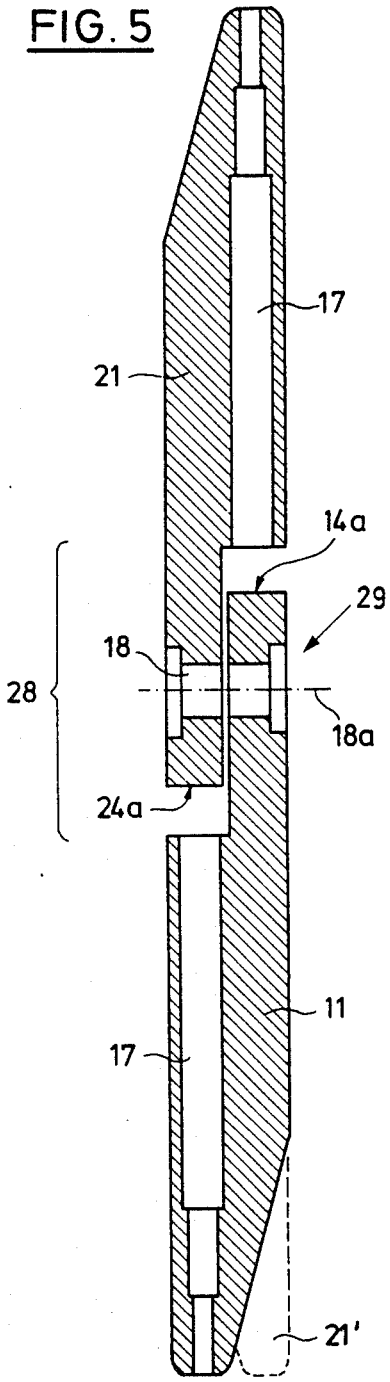
FIG. 5 is a lengthwise section through two opened out housings according to FIG. 1 joined together but without cartridges etc., and, FIG. 6 is a partial section through a complete writing implement in the opened out position on a section plane at 90° to that of FIG. 5.

The two identical housings 11 and 21 are, as seen in FIG. 5 connected together facing each other so that a pivot pin 30 can be snapped into the aligned transverse bores 18. This pin is mushroom-shaped in lengthwise section and, by virtue of a diametral slot, has two sprung tongues. The mid-part of this whole arrangement is shown as a connecting part 28. A pivot 29 is formed by the pivot pin 30 by which the two housings are fastened together for relative movement. The arrangement is, as seen in FIG. 5, designed so that the bore 17 of one housing is pointed at the cam **14*a*,24*a* of the other. The two bores 17 are thus necessarily arranged side-by-side so that the narrowed outer ends of the housings 11 and 21 to not coincide. Rather, as the lower part of FIG. 5 shows, the end of the pivoted-round housing 21, shown in broken line, is not only behind the housing 11** but also set to one side of it.

Thus, through the all round narrowing of the housings (FIG. 4) the writing implement can be easily pushed in clamping fashion on to the edge of a pocket.

FIG. 6 shows, in contradistinction to FIG. 4, the geometric relation of the opened-out writing implement in its operational position. While the writing point **12*a* (only this one is shown) in FIG. 4 is inside the housing 11, in FIG. 6 both writing points 12*a* and 22*a* are driven out of their housings so that the writing implement is adapted for writing. It is also clearly seen that the two cams 14*a* and 24*a* are eccentric with respect to the pivot axis 30. The spring 19 is shown in a more compressed condition than in FIG. 4, so that a pivoting movement out of the position shown in FIG. 6, is possible initially only against an increasing spring force, while the spring force assists the closing together of the housings at the end of the pivot motion, as the cam face 26 comes under the influence of the parts 14*b*,24*b***.

It can be seen that plunger 13,23 which is guided in the one housing 11,21 runs with its cam face 26 on the cam **24*a*,24*a* of the other housing. Because the cams 14*a* and 24*a*, especially their parts 14*b* and 24*b*, on the same side of the pivot pin 30 as the barrels 16, have their smallest spacing from the pivot axis, the writing points 12*a* and 22*a*** are in the closed position further inside the housings, and in the opened-out position correspondingly far outside the housings.

In assembly, first the springs 19 and then the plungers 13,23 are inserted into the lengthwise bores 17. The two housings are then, with the springs 19 compressed, joined together by snapping in the pivot pin 30. The surface should be properly rounded off all over so as to give the user a good feeling which is necessary for a writing implement.

I claim:

1. Writing implement comprising: two writing cartridges, each of said cartridges having a spring and a housing enclosing the cartridge and spring; a writing point in each cartridge at one end of the cartridge; said cartridges being spring-loaded by the springs; connecting means for connecting the housings, said connecting means comprising a pivot for relative pivoting of the two housings; a cartridge displacement cam on each housing at a pivot end of the housing remote from the writing point, said cam for displacing lengthwise the other cartridge; the cams being so shaped that the writing points project out of the housings when the housings are substantially opened out and the housings are rotated about said pivot at a substantial angle relative to each other, said writing points being retracted into said housings when said angle is substantially reduced; said two housings and said connecting means forming a clamp having a closed position in which said angle is substantially zero and said housings are together in contact in substantially parallel relationship, said writing points being fully retracted in said closed position, said clamp being clampingly attachable to an edge of a garment worn by a user, said writing points being projected out of said housings by said cams when said clamp is in open position and said angle is substantially an obtuse angle.

2. Writing implement according to claim 1, wherein the housing comprises a tubular barrel having a lengthwise bore receiving the spring and cartridge, a flattened hinge part being arranged to a side of said bore; a transverse bore for a pivot pin, an end of said transverse bore having said cam; said two housings being connected together by their hinge parts with the transverse bores aligned so that the lengthwise bore in each housing is pointed towards the cam of the other housing.

3. Writing implement according to claim 2, wherein said two housings and said cams are formed integrally from a thermoplastic synthetic material.

4. Writing implement according to claim 3, wherein said two housings are identical.

5. Writing implement according to claim 1, wherein said cams have shaped means so that in closed position of said housings a section with a greater inclination with respect to a pivot axis of said pivot acts on the spring loaded cartridges.

6. Writing implement according to claim 5, wherein said cams have shaped means so that the spring loaded cartridges have substantially a small retractile motion as the housings reach their opened position.

7. Writing implement according to claim 1, including an abutment lock at the end of the cam corresponding to the opened position of the housings, said abutment lock locking said housings in their opened position.

8. Writing implement according to claim 1, including a plunger between an end of the cartridge and the cam.

9. Writing implement according to claim 8, wherein said plunger is guided in said lengthwise bore and abuts against the spring.

10. Writing implement according to claim 9, wherein said plunger has a hollow projection serving as a guide element into which the end of the cartridge can be inserted and held.

11. Writing implement according to claim 1, wherein said cams have cam faces formed at least partly eccentrically to said pivot.

12. Writing implement comprising: two writing cartridges, each of said cartridges having a spring and a housing enclosing the cartridge and spring; a writing point in each cartridge at one end of the cartridge; said cartridges being spring-loaded by the springs; connecting means for connecting the housings, said connecting means comprising a pivot for relative pivoting of the two housings; a cartridge displacement cam on each housing at a pivot end of the housing remote from the writing point, said cam for displacing lengthwise the other cartridge; the cams being so shaped that the writing points project out of the housings when the housings are substantially opened out and the housings are rotated about said pivot at a substantial angle relative to each other, said writing points being retracted into said housings when said angle is substantially reduced; said two housings and said connecting means forming a clamp having a closed position in which said angle is substantially zero and said housings are together in contact in substantially parallel relationship, said writing points being fully retracted in said closed position, said clamp being clampingly attachable to an edge of a garment worn by a user, said writing points being projected out of said housings by said cams when said clamp is in open position and said angle is substantially an obtuse angle; said housing comprising a tubular barrel having a lengthwise bore receiving the spring and cartridge, a flattened hinge part being arranged to a side of said bore; a transverse bore for a pivot pin, an end of said transverse bore having said cam; said housings being connected together by their hinge parts with the transverse bores aligned so that the lengthwise bore in each housing is pointed towards the cam of the other housing; said two housings and said cams being formed integrally from a thermoplastic synthetic material; said housings being substantially identical; said cams having shaped means so that in closed position of said housings a section with a greater inclination with respect to a pivot axis of said pivot acts on the spring loaded cartridges; said cams having shaped means so that the spring loaded cartridges have a substantially small retractable motion as the housings reach their opened position; an abutment lock at the end of the cam corresponding to the opened position of the housings, said abutment lock locking said housings in their opened position; a plunger between an end of the cartridge and the cam; said plunger being guided in said lengthwise bore and abutting against the spring; said plunger having a hollow projection serving as a guide element into which the end of the cartridge can be inserted and held; said cams having cam faces formed at least partly eccentrically to said pivot.

* * * * *